US008049129B2

(12) United States Patent
Wristen et al.

(10) Patent No.: US 8,049,129 B2
(45) Date of Patent: Nov. 1, 2011

(54) HOUSING FOR A VACUUM INTERRUPTER MODULE

(75) Inventors: Cecil C. Wristen, Hudson, OH (US); James G. Meadows, Garrettsville, OH (US)

(73) Assignee: Vacuum Electric Switch Co., Akron, OH (US)

( * ) Notice: Subject to any disclaimer, the term of this patent is extended or adjusted under 35 U.S.C. 154(b) by 640 days.

(21) Appl. No.: 12/220,809

(22) Filed: Jul. 29, 2008

(65) Prior Publication Data

US 2010/0025377 A1 Feb. 4, 2010

(51) Int. Cl.
*H01H 33/66* (2006.01)

(52) U.S. Cl. ..... 218/134; 218/139; 218/140

(58) Field of Classification Search ..... 218/118–120, 218/134–140, 155

See application file for complete search history.

(56) References Cited

U.S. PATENT DOCUMENTS 4,704,508 A * 11/1987 Heyde ..... 218/57
6,172,317 B1 1/2001 Wristen ..... 218/138

* cited by examiner

*Primary Examiner* — Renee S Luebke
*Assistant Examiner* — Marina Fishman
(74) *Attorney, Agent, or Firm* — Renner Kenner Greive Bobak Taylor & Weber

(57) ABSTRACT

A housing for a vacuum interrupter module that resists fracture when fasteners received therethrough are tightened, comprises an elongated hollow body from which a mounting flange extends from at least one end. Extending between the mounting flange and the body and/or coextensive with the mounting flange is a curved transition that maintains at least one curved recess, which partially surrounds corresponding mounting bores that are configured to receive suitable fasteners to mount the housing. Once mounted, the curved transition prevents stress forces imparted by the fasteners from deflecting the mounting flange, thereby inhibiting the formation of fractures therein.

9 Claims, 7 Drawing Sheets

HOUSING FOR A VACUUM INTERRUPTER MODULE

TECHNICAL FIELD

The present invention relates generally to vacuum interrupter modules. Particularly, the present invention relates to a housing containing a vacuum interrupter. Specifically, the present invention relates to a housing for containing a vacuum interrupter that provides a mounting flange that is configured to prevent fracture when the vacuum interrupter module is mounted.

BACKGROUND ART

Vacuum interrupter modules are used to control the application of large amounts of electrical power to an electrical load. These vacuum interrupters are maintained within an electrically insulated housing so as to prevent them from encountering environmental elements, such as snow and rain, as well as from encountering other debris that may interfere with the operation of the vacuum interrupter. To achieve such operation, the housings are typically made from a non-metallic material, such as ceramic or epoxy, which has been found suitable for electrically insulating the interrupter module.

To facilitate the mounting of the interrupter module, the housings are typically mounted to a platform or other base where the vacuum interrupter module can be rigidly affixed. Different manners for enabling the attachment of the interrupter module have been utilized. One way of attachment is to provide a mounting flange at the base of the interrupter module housing which provides a plurality of mounting bores. Furthermore, in some circumstances, the housing may provide mounting flanges at each end of the housing to facilitate the series coupling of multiple interrupter modules. However, housing designs have long suffered from being too fragile, such that the mounting flange, as well as other parts of the housing, are highly susceptible to fracture upon tightening of the bolts received through the mounting bores. For example, as the mounting bolts are torqued down to fasten the housing to a suitable base, the mounting flange becomes stressed causing it to deflect. The deflection of the mounting flange results in a fracture developing in the flange, which is permitted to propagate along a radius located between a bore in the flange through which the fastener is received and the main body of the housing. Unfortunately, however the propagation of the fracture is permitted to continue until it reaches the edge of the flange, thus resulting in the structural failure of the mounting flange.

Over the years, manufacturers have transitioned from fabricating the housing from ceramic based materials to epoxy based materials. Unfortunately, this transition has proved to have had a minimal effect on making the housing and mounting flange more resistant to fractures. As such, current vacuum interrupter module housings are still highly susceptible to fracture when the associated fasteners are exposed to a relatively minimal amount of torque.

Thus, in an effort to prevent the fracturing of vacuum interrupter module housings in light of the known deficiency in its structure, manufacturers have adopted torque specifications for the mounting bolts. For example, many current interrupter module housing designs require that the torque applied to the bolts received within the mounting bores be limited to approximately 25 in-lbs so as to reduce the likelihood of fracturing the mounting flange. However, such torque specifications employed in the industry are comparatively low, and thus, such a restriction on fastening torque may inadvertently be exceeded during installation or operation resulting in a fractured flange of the module housing.

Furthermore, because of the comparatively low amount of torque permitted to be applied to the fastening bolts, the torque settings on the tools used to fasten the bolts must be calibrated with increased precision to ensure that the bolts are fastened to their upper torque limit to prevent loosening over time. Furthermore, because the bolts are fastened to their upper torque limit, should the attachment flange be subjected to external forces, such as wind or that from external debris, the attachment flange may fracture due to stress sustained thereby, which may lead to the failure of the vacuum interrupter module.

Additionally, past designs of the vacuum interrupter module housings have been configured with the electrical handling and isolation properties of the housing in mind. As such, designers of the housings made the paths for which leakage current can pass made as long as possible and of equal length. Such a design was implemented so as to minimize the amount of leakage current that is permitted to pass over the surface of the housing and to ensure that the current loss of the housing would be minimized.

While the design of existing interrupter module housings have been optimized to minimize leakage currents in a controlled manner, other aspects of the housing design, in particular the structural aspects, have not been give the same amount of consideration. And it is for this reason that there still exists a long-felt need for a vacuum interrupter housing that is structurally resistant to fractures in and about its mounting flange.

Therefore, there is a need for a housing for a vacuum interrupter that eliminates sharp transitions between the mounting flange and housing body so as to prevent the development and propagation of fractures in the interrupter module housing. Additionally, there is a need for a housing for a vacuum interrupter module that provides at least one mounting flange that provides mounting bores that can receive fasteners that can be tightened with increased torque without fracturing the mounting flange. In addition, there is a need for a housing for a vacuum interrupter module that provides a curved transition between a housing body and at least one mounting flange that extends therefrom. In addition, there is a need for a housing for a vacuum interrupter module that provides at least one mounting flange that includes at least one mounting aperture disposed within a contoured counterbore at least partially disposed within a curved transition between the body and the at least one mounting flange.

DISCLOSURE OF THE INVENTION

In light of the foregoing, it is a first aspect of the present invention to provide a housing for a vacuum interrupter module.

It is another aspect of the present invention to provide a vacuum interrupter module comprising an elongated housing body having an end from which a mounting flange extends, the mounting flange extending from the end, so as to form a curved transition therebetween, the mounting flange maintaining at least one mounting aperture therethrough, a vacuum interrupter disposed within the housing, the vacuum interrupter coupled between an input terminal pad and an output terminal pad, and a switching mechanism coupled to the vacuum interrupter to actuate the vacuum interrupter between on and off states.

Yet another aspect of the present invention is to provide a housing for a vacuum interrupter module comprising an elongated housing body having opposed ends, a mounting flange extending from at least one of the ends so as to form a curved transition therebetween, the mounting flange maintaining an outer surface opposite an inner surface, and at least one mounting bore disposed through the mounting flange.

BRIEF DESCRIPTION OF THE DRAWINGS

For a complete understanding of the objects, techniques and structure of the invention, reference should be made to the following detailed description, appended claims and accompanying drawings, wherein:

BEST MODE FOR CARRYING OUT THE INVENTION

A housing for a vacuum interrupter module configured to prevent the development of fractures when mounted is generally referred to by the numeral 10, as shown in the Figs. For the purpose of the discussion that follows, the term "fracture" is defined as any full or partial structural failure, including but not limited to cracks, breaks, fissures, and the like. Furthermore, before discussing the fracture reducing features of the housing 10 contemplated by the present invention, a brief discussion of a prior art housing 11 maintained by a vacuum interrupter module 12 will be presented to facilitate the reader's understanding of the housing 10.

Figure 1:
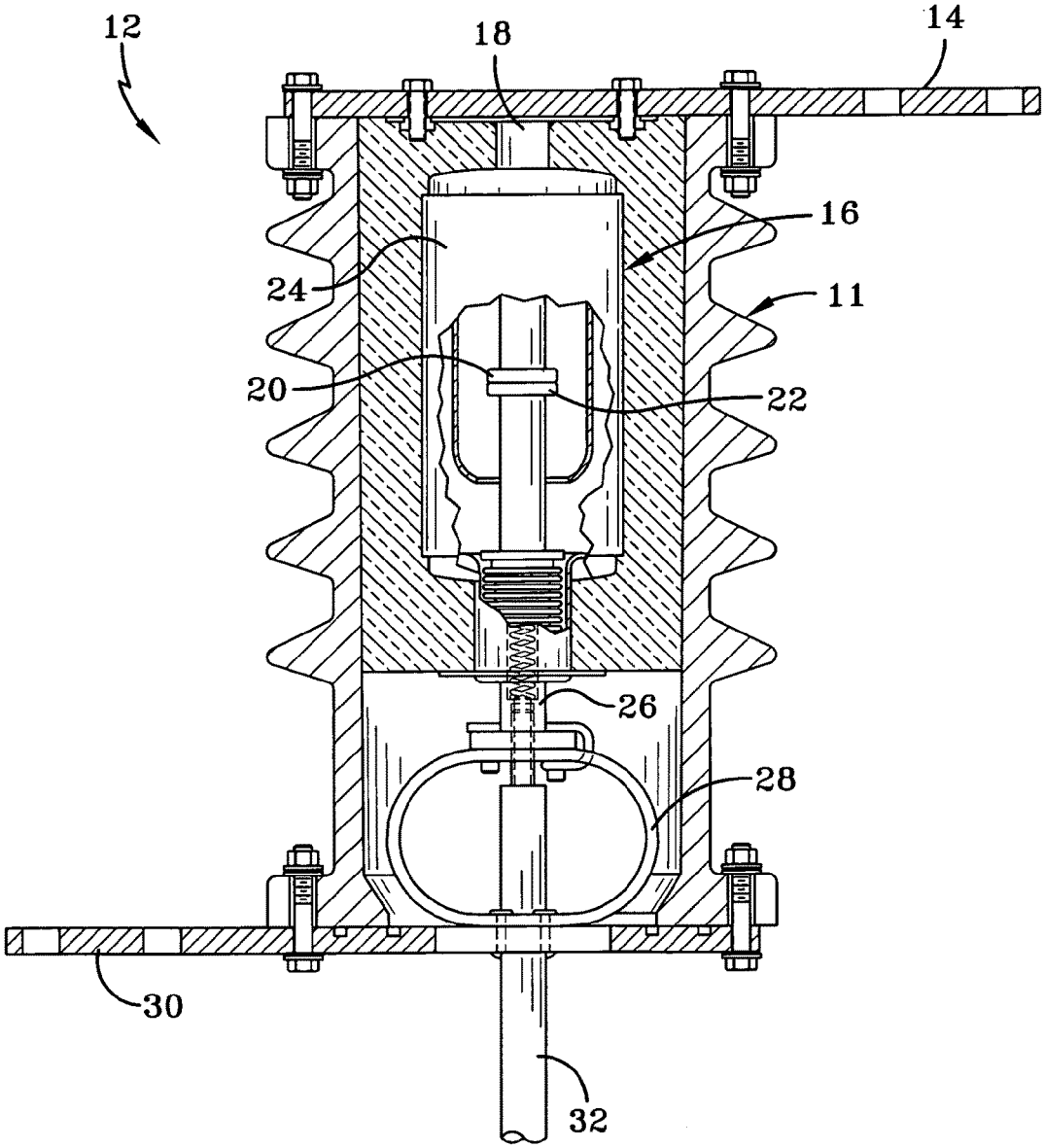
FIG-1 PRIOR ART
FIG. 1 is a cross-sectional view of a prior-art vacuum interrupter module that is susceptible to fracture.

As shown in FIG. 1, the prior art vacuum interrupter module 12 includes an upper terminal pad 14 that provides an electrical and mechanical connection to a furnace or other piece of electrical equipment operating at high voltage. The upper terminal pad 14 is electrically connected to a vacuum interrupter 16 through a stationary stem 18 that is also electrically connected to a stationary contact 20. The stationary contact 20 is mateable with a moving contact 22. As such, the moving contact 22 connects to and is mated with the stationary contact 20 to complete the current path to the furnace or other electrical equipment. The moving contact 22 and the stationary contact 20 are sealed within the highly evacuated vacuum container 24. The moving contact 22 is connected to a moving stem 26 that axially extends from the vacuum container 24, and which is attached to a flexible shunt 28. The flexible shunt 28 is connected at its opposite end to a lower terminal pad 30, thus allowing the contacts 20 and 22 to be opened and closed as a pull rod 32 connected to the moving contact 22 is actuated. In order to protect the vacuum interrupter module 12 from the outside environment, the housing 11 is disposed about the components of the vacuum interrupter module 12. However, due to the structural characteristics of the housing 11, it suffers from the drawbacks previously discussed in regard to prior art interrupter module housings, and as such is susceptible to fracture.

Thus, with the prior art housing 10 set forth, a discussion of the particular features of the housing 10 maintained by the present invention will now be presented below. However, before setting forth the features of the housing 10 in detail, it should be appreciated that the housing 10 contemplated herein reduces the potential for fractures that develop in and about a mounting flange maintained by the housing 10. As such, the housing 10 of the present invention achieves a significant improvement to its structural integrity, which has long plagued vacuum interrupter module housing designs. In other words, changes to the design of the shape of the housing 10 in the regions of the mounting flange, and regions about the mounting fasteners reduces the mechanical stress concentrations in the regions proximate the mounting flange and mounting bores disposed therethrough, so as to minimize fracture. As such, the housing 10 contemplated by the present invention is optimized to provide suitably small leakage currents that are equivalent or nearly equivalent to past interrupter module housing designs, while also providing a housing with enhanced structural performance that is resistant to mechanical fractures in and about the mounting flange. As such, the housing 10, which is the basis for the discussion that follows, has increased structural strength, while still being able to minimize leakage currents therethrough at a level that is equivalent or nearly equivalent to existing housing designs previously discussed.

Figure 2:
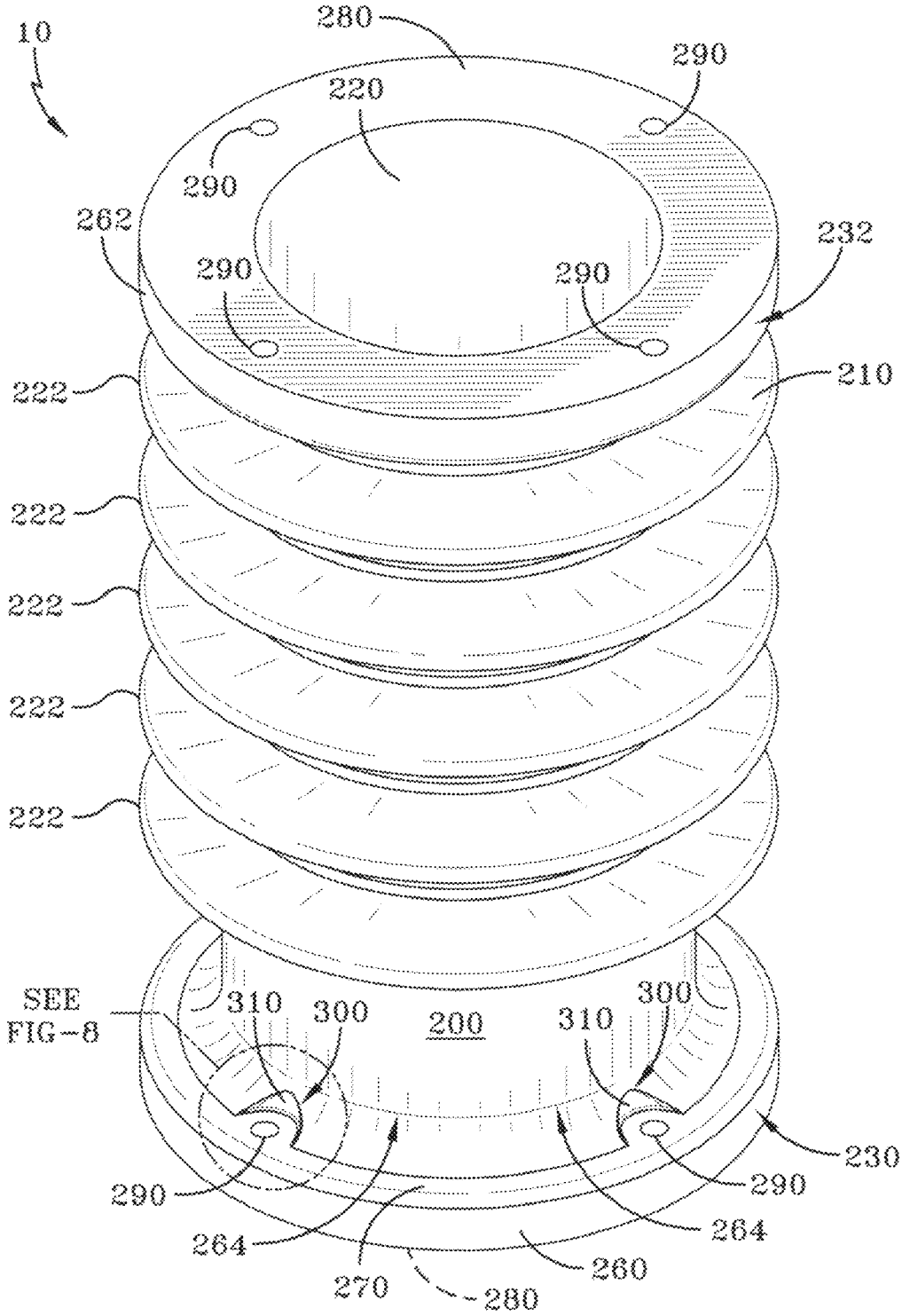
FIG. 2 is a perspective view of a vacuum interrupter module housing in accordance with the concepts of the present invention.
Figure 3:
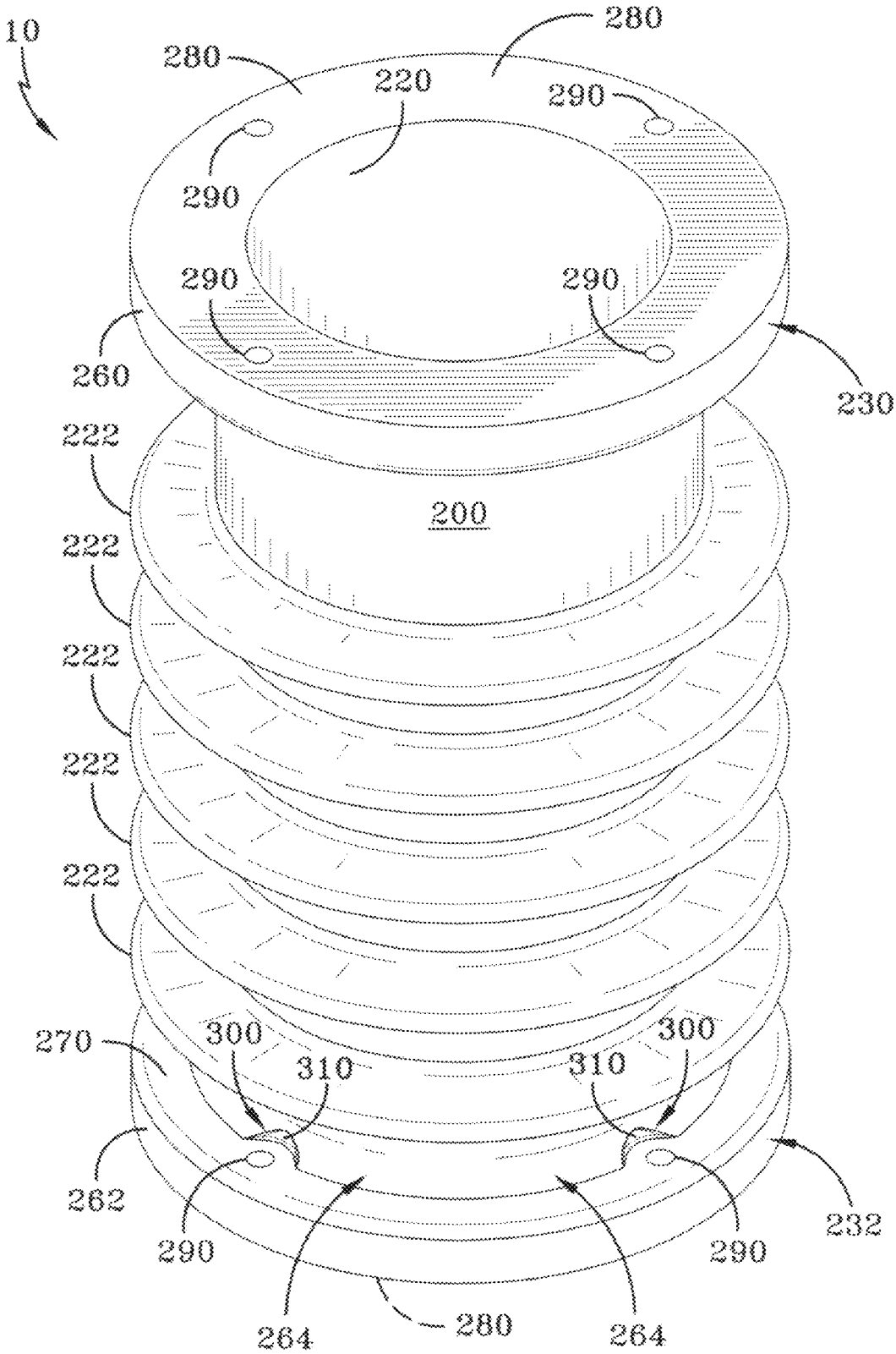
FIG. 3 is another perspective view of the vacuum interrupter module housing in accordance with the concepts of the present invention.
Figure 4:
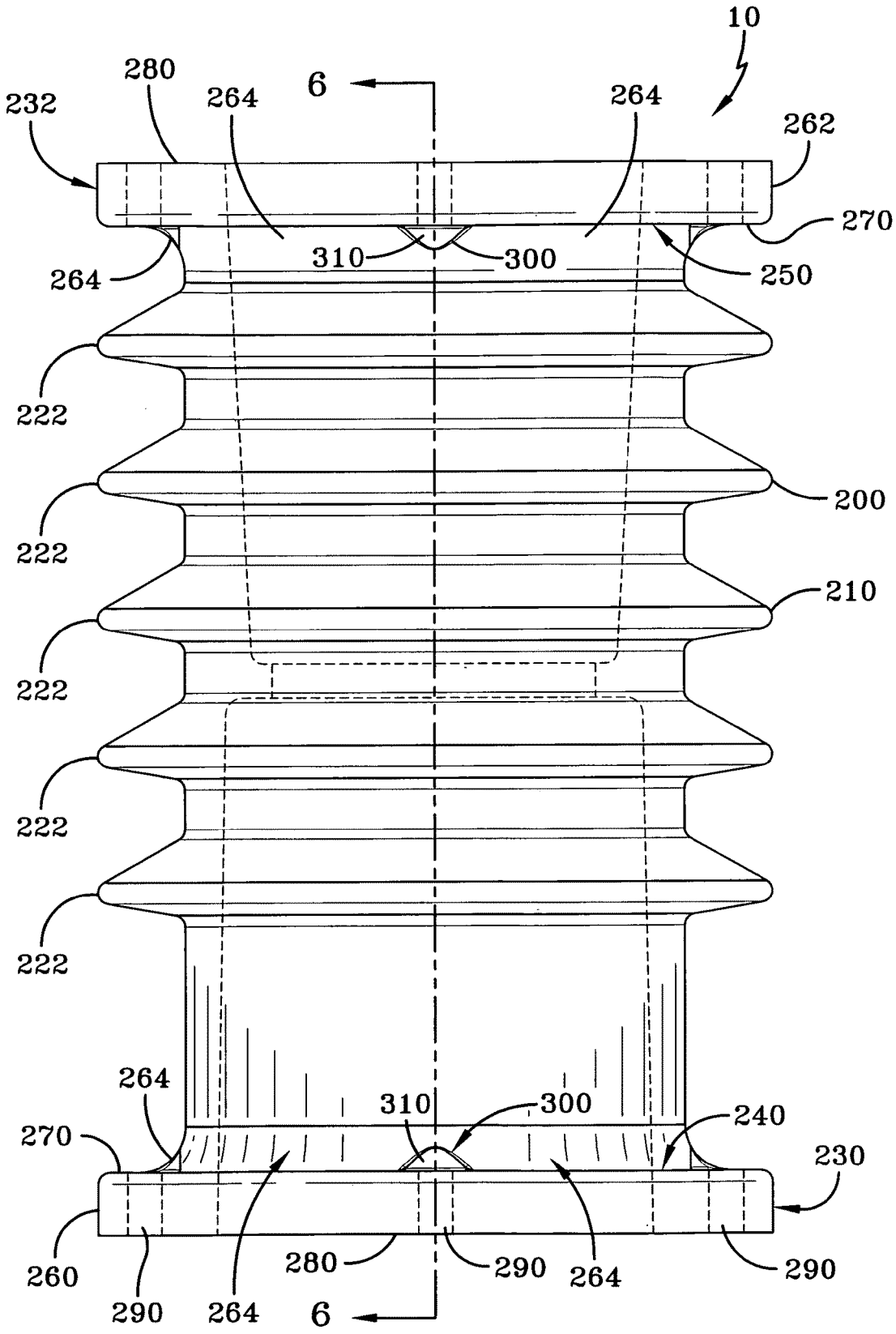
FIG. 4 is an elevational view of a curved recess disposed within a curved transition maintained by a mounting flange maintained by the housing in accordance with the concepts of the present invention.
Figure 5:
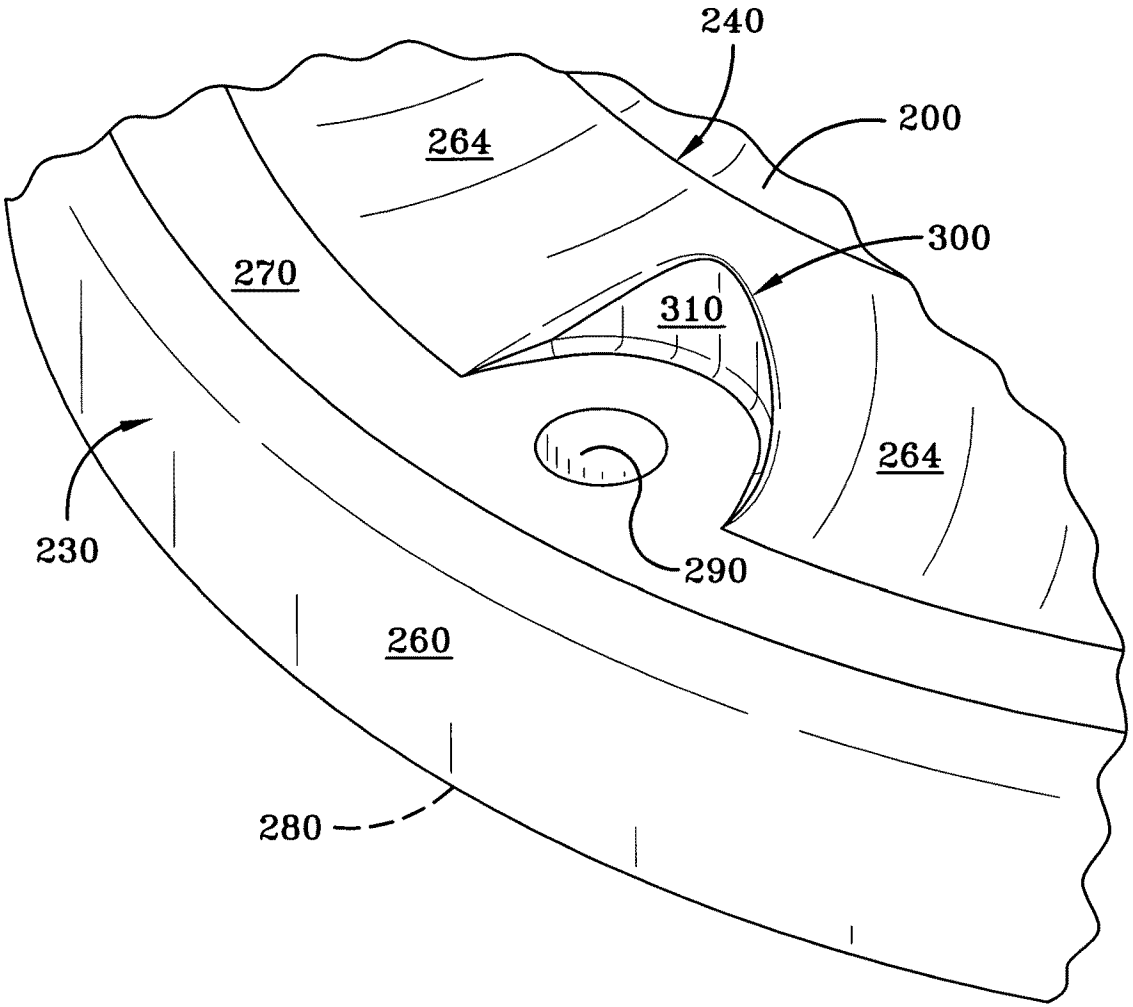
FIG. 5 is an enlarged perspective view of the mounting flange in accordance with the concepts of the present invention.

As shown in FIGS. 2 and 3, the vacuum interrupter module housing 10 comprises an elongated hollow body 200 that maintains an outer surface 210 and an inner surface 220. In one aspect, the housing 10 may be formed of alphatic epoxy that is filled with alumina trihydrate, although other suitable materials, such as ceramic materials, may be used. Continuing, the outer surface 210 of the body 200 is substantially cylindrical in shape and may include one or more convolutions 222 that extend radially therefrom. However, it should be appreciated that the body 220 may take on any suitable rectilinear or curvilinear shape. A pair of solid, or partially solid mounting flanges 230, 232 extend from respective ends 240,250 of the body 200 at a substantially right angle to form respective edges 260,262, as shown in FIG. 4. Because the mounting flange 230 is structurally equivalent to mounting flange 232, the following description will present only the components relating to that of flange 230.

In particular, the mounting flange 230 extends from the body 200, such that a curved transition 264 is formed between the body 200 and the mounting flange 230. In other words, the curved transition 264 circumscribes the region of the housing 10 that is between the body 200 and the mounting flange 230. The mounting flange 230 includes an outer surface 270 that is opposite an inner surface 280 through which a plurality of mounting bores 290 are disposed, as shown in FIGS. 5-8. In one aspect, it should be appreciated that the curved transition 264 may be coextensive with at least part of the outer surface 270 of the mounting flange 230, thereby causing at least part of the outer surface 270 to be curved or otherwise contoured. The mounting bores 290 are at least partially surrounded by a curved recess 300 that is at least partially disposed within the curved transition 264. The curved recesses 300 maintain a curved wall surface 310 that partially extends about the mounting bores 290. Although the recesses 300 are discussed herein as being curved, the recesses may be a combination of curvilinear and rectilinear shapes. In yet another aspect, it should be appreciated that the transition 264 may extend completely about the mounting bores 290 so that they are surrounded by the curved transition 264.

Figure 6:
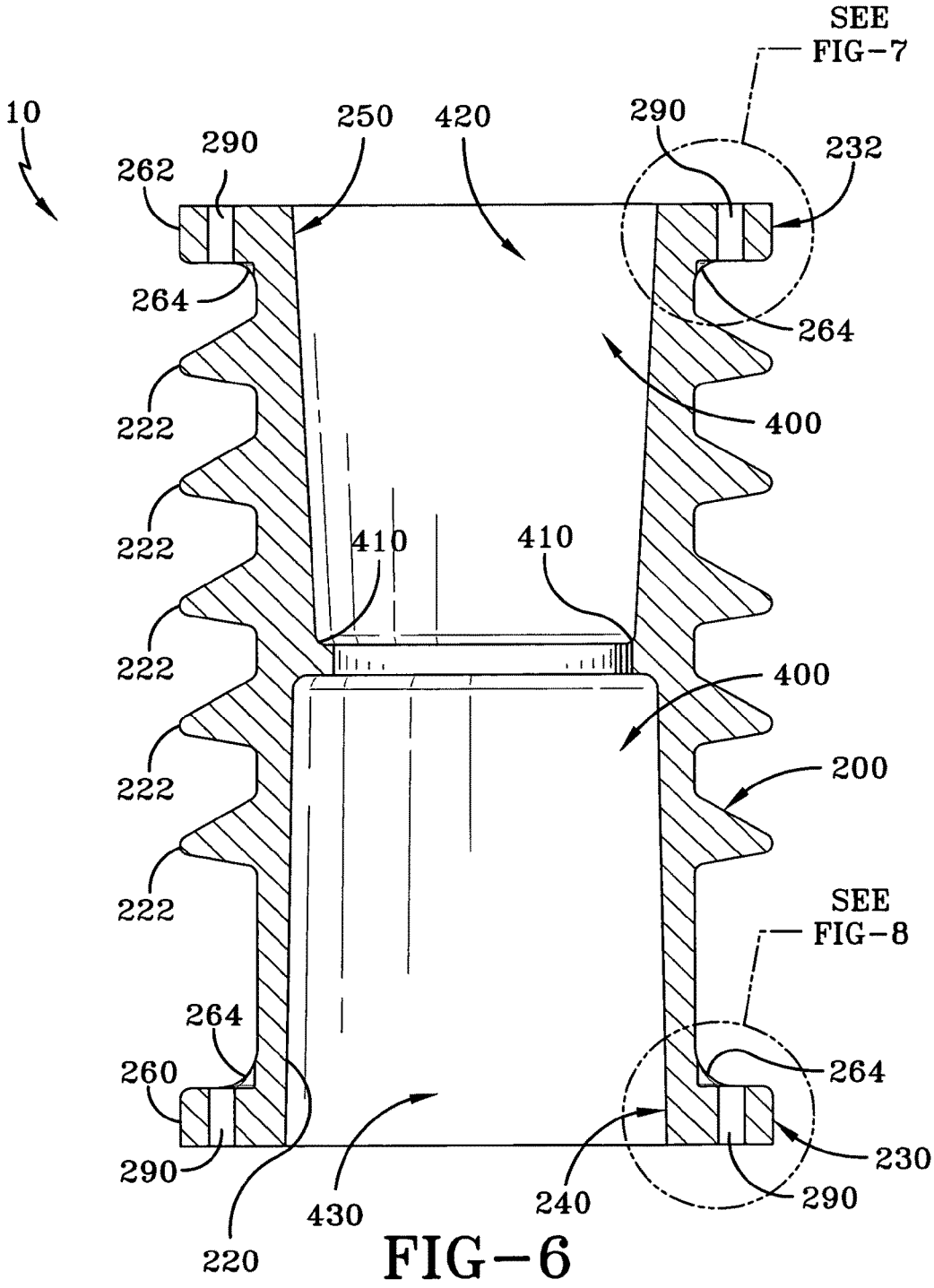
FIG. 6 is a cross-sectional view taken along lines 6-6 of FIG. 4 of the vacuum interrupter module housing in accordance with the concepts of the present invention.
Figure 7:
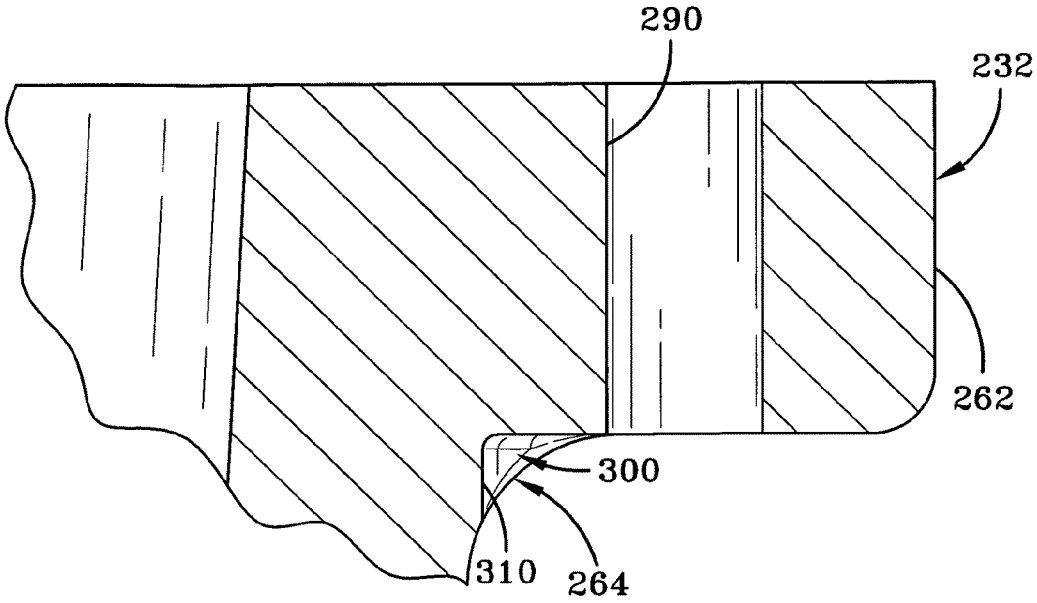
FIG. 7 is an enlarged cross-sectional view of one of the mounting flanges maintained by the housing showing the curved transition in accordance with the concepts of the present invention.
Figure 8:
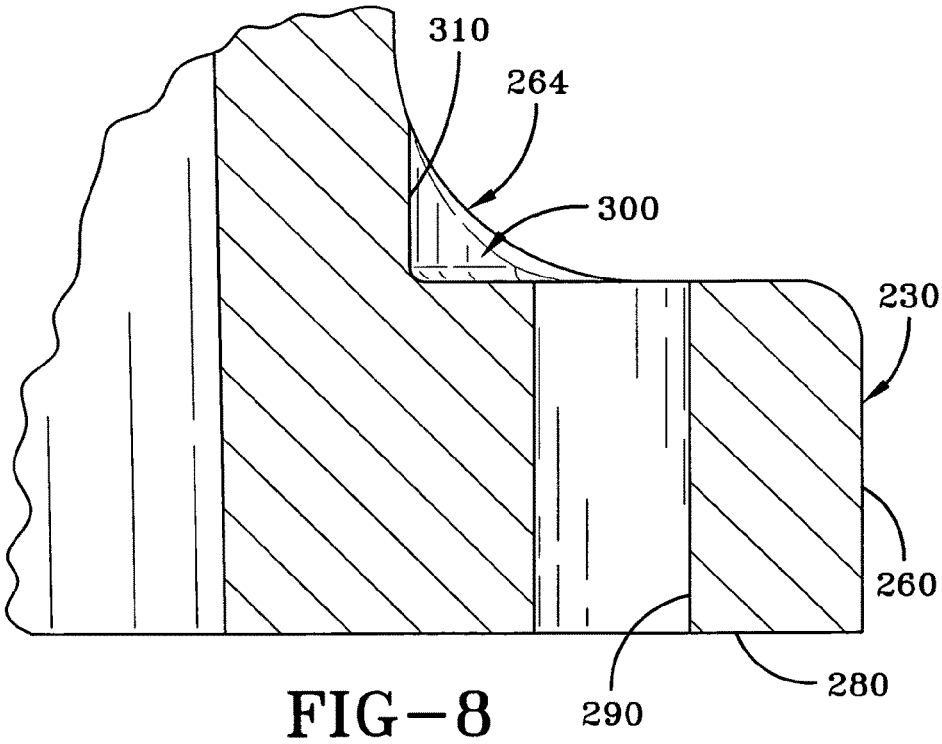
FIG. 8 is an enlarged cross-sectional view of another of the mounting flanges maintained by the housing showing the curved transition in accordance with the concepts of the present invention.

The inner surface 220 of the body 200, shown in FIG. 6, defines an open substantially cylindrical void 400, which serves as a mounting region for the components of the interrupter module 20 previously discussed. In addition, a ledge 410 may be disposed upon the inner surface 220 at a point that is about midway between the ends 240, 250 of the housing 10. The ledge 410 is provided to support one or more of the structures of the interrupter module 20 maintained within the housing 10. It should also be appreciated that the ledge 410 may also serve to separate the void 400 into two separate regions 420 and 430.

As such, when the housing 10 is fastened in a desired position by placing suitable fasteners through the mounting bores 290 and tightening them, the curved transition 264 provides suitable resistance to the deflection forces imparted to the flange 230 via the fasteners. That is, the curvilinear profile of the curved transition 264 serves to withstand the deflection forces of the fasteners when tightened within the mounting bores 290. Furthermore, the curved profile of the curved recess 300 also contributes to the housing's resistance to fracture as well. As such, the curved transition 264 prevents the formation of fractures, and prevents any fractures that have been created from propagating to the edge 260 of the flange 230. As a result, the fasteners received within the mounting bores 290 may be tightened with a greater amount of torque than is currently applied to existing vacuum interrupter module housings. For example, the fastener may be tightened such that the head of the fastener imparts a force of approximately 100 inch-pounds of torque thereto without fracturing the mounting flange 230 or the body 200 of the housing 10. Such a feature is beneficial in that the technicians who are charged with installing the vacuum interrupter modules 20 maintained within the housing 10 may be mounted with reduced failures of the interrupter module. Furthermore, because of the additional amount of torque that can be applied to the fasteners received within the mounting bores 290, the operation of the vacuum interrupter module is made more reliable.

It will, therefore, be appreciated that one advantage of one or more embodiments of the present invention is that a housing for a vacuum interrupter module provides a mounting flange that is able to receive fasteners tightened with increased torque without fracturing the housing so as to more rigidly affix the interrupter module in position. Another advantage of the present invention is that a housing for a vacuum interrupter module provides a mounting flange maintaining a plurality of contoured recesses which prevents the housing from fracturing when a fastener received therethrough is tightened. Yet another advantage of the present invention is that a housing for a vacuum interrupter module provides a curved transition between a body of the housing and a mounting flange extending therefrom, which prevents the housing from fracturing when a fastener is received through the flange and tightened.

Although the present invention has been described in considerable detail with reference to certain embodiments, other embodiments are possible. Therefore, the spirit and scope of the appended claims should not be limited to the description of the embodiments contained herein.

What is claimed is:

1. A vacuum interrupter module comprising:

an elongated housing body having an end from which a mounting flange extends, said mounting flange extending from said end, so as to form a curved transition therebetween, said curved transition having at least one recess having a curved wall, said mounting flange maintaining at least one mounting aperture therethrough, wherein said at least one mounting aperture is partially surrounded by said curved wall;

a vacuum interrupter disposed within said housing, said vacuum interrupter coupled between an input terminal pad and an output terminal pad; and a switching mechanism coupled to said vacuum interrupter to actuate said vacuum interrupter between on and off states.

2. The vacuum interrupter module of claim 1, wherein said recess is curvilinear.

3. The vacuum interrupter module of claim 1, wherein said mounting flange extends from said housing body at a substantially right angle.

4. The vacuum interrupter module of claim 1, wherein said curved transition is coextensive with at least a portion of an outer surface of said mounting flange.

5. The vacuum interrupter module of claim 1, wherein said mounting flange extends at substantially a right angle and has an outer surface, and said mounting flange is coextensive with said curved transition between said mounting flange and said end of said elongated housing body so that at least part of said outer surface is curved.

6. A housing for a vacuum interrupter module comprising:

an elongated housing body having opposed ends;

a mounting flange extending from at least one of said ends;

a curved transition extending between said housing body and said mounting flange, said mounting flange maintaining an outer surface opposite an inner surface; and at least one mounting bore disposed through said mounting flange, said mounting bore receiving a fastener, wherein said curved transition provides resistance to deflection forces imparted to said outer surface of said mounting flange by the fastener, and wherein said at least one mounting bore is disposed within a recess at least partially disposed within said curved transition.

7. The housing of claim 6, wherein said recess is curvilinear.

8. The housing of claim 6, wherein said mounting flange extends from said housing body at a substantially right angle.

9. The housing of claim 6, wherein said curved transition is coextensive with at least part of said outer surface of said mounting flange.

* * * * *